US006837744B2

(12) United States Patent
To et al.

(10) Patent No.: US 6,837,744 B2
(45) Date of Patent: Jan. 4, 2005

(54) ELECTRICAL CONNECTOR FOR AIRCRAFT FUEL PUMPS

(75) Inventors: Irwin Hei-Wai To, Simi Valley, CA (US); Roderick J. Hunt, Acton, CA (US); Berardino C. Scanderbeg, Valencia, CA (US); Michael Shlimovich, Woodland Hills, CA (US)

(73) Assignee: Hydro-Aire, Inc., Burbank, CA (US)

( * ) Notice: Subject to any disclaimer, the term of this patent is extended or adjusted under 35 U.S.C. 154(b) by 0 days.

(21) Appl. No.: 10/099,882

(22) Filed: Mar. 13, 2002

(65) Prior Publication Data

US 2003/0176105 A1 Sep. 18, 2003

(51) Int. Cl.[7] ..... H01R 13/40
(52) U.S. Cl. ..... 439/587; 439/281
(58) Field of Search ..... 439/587, 281, 439/271, 274, 874, 606; 174/65 G, 151

(56) References Cited

U.S. PATENT DOCUMENTS 4,233,534 A * 11/1980 Tharman ..... 310/71
4,987,283 A * 1/1991 Beinhaur et al. ..... 219/85
6,165,013 A * 12/2000 Broussard ..... 439/606

* cited by examiner

*Primary Examiner*—Alex Gilman
(74) *Attorney, Agent, or Firm*—Fulwider Patton Lee & Utecht, LLP

(57) ABSTRACT

The improved electrical connector for aircraft fuel pumps includes a unitary cup-shaped connector shell with an outer radial connector flange, and is configured to increase the distance between connector pins and grounded portions of the connector shell to thus increase the electrical current leak path length to prevent arcing from occurring. A glass electrical insulating plug in the connector shell forms a hermetic seal of the closed end of the connector shell and a plurality of ceramic tubular risers are mounted to the glass insulating plug. Connector pins extend through the risers, and electrical cables are connected to the connector pins. One or more outer layers of heat shrunk electrical insulating tubing cover the risers, a portion of the connector pins extending from the risers, and the electrical cables. An electrical insulating tubular extension may also be placed over the outer layer of insulating tubing.

21 Claims, 1 Drawing Sheet

ELECTRICAL CONNECTOR FOR AIRCRAFT FUEL PUMPS

BACKGROUND OF THE INVENTION

This invention relates generally to electrical control systems, and more specifically relates to an electrical connector for aircraft fuel pumps.

A conventional electrical connector 10 for aircraft fuel pumps is illustrated in FIG. 1. The electrical connector includes a cup-shaped connector shell 12 with an outer radial connector flange 14 approximately 0.080 inch thick, and a glass electrical insulating plug 16 mounted in the cup-shaped connector shell. A plurality of connector pins 18 are mounted in the glass insulating plug, each having a portion 20 extending from the glass insulating plug and covered by potting 22, such as an epoxy resin potting compound, for example. Electrical cables (not shown) would also extend through the potting to the individual connector pins.

In aircraft, electrical arcing in the presence of a fuel leak can lead to disastrous results. Airworthiness Directive (AD 97-03-17) issued following reports of fuel leaks at the fuel boost and override/jettison pumps, and electrical arcing that occurred on JAL 747 aircraft, which resulted from formation of a conductive layer between potting of the connector and electrical insulation glass of the connector. The conductive layer provided an electrical path for arcing to occur between connector pins, or between one or more connector pins and the casing of the connector, which was severe enough to burn through the connector shell, allowing fuel to leak to the environmental side of the fuel pump. The potting of the connector formed an imperfect seal with the connector, and contributed to the severity of the arcing condition by allowing contamination to become trapped in the connector, which initiated arcing. In addition, the potting of the connector contained the arcing event, allowing extreme heat and pressure to build up. Subsequent carbonization of the potting provided a conductive path for the arc and provided additional material to sustain the arcing reaction which could burn through surrounding material to permit a fuel leak to occur.

It would therefore be desirable to provide an improved, non-potted open design for an electrical connector for aircraft fuel pumps, allowing potential contaminants to escape or be removed from the electrical connector. It would also be desirable to provide an improved electrical connector for aircraft fuel pumps with an improved glass hermetic seal, connector flange and electrical insulating risers to provide electrical insulation and an increased current leakage path between each pin of the connector and between the connector pins and the connector housing. It would also be desirable to provide strain relief and improved electrical insulation of the electrical connector. There, thus exists a need for an improved electrical connector for fuel pumps, particularly for aircraft. The present invention addresses these and other concerns.

SUMMARY OF THE INVENTION

Briefly, and in general terms, the present invention provides for an improved electrical connector for aircraft fuel pumps. The improved electrical connector has a non-potted, open design, allowing potential contaminants to escape or be removed from the electrical connector, and includes thickened glass hermetic seal and connector flange portions, electrical insulating risers providing an increased current leakage path between connector pins and between the connector pins and the connector housing, and improved strain relief and electrical insulation extending over a portion of electrical cables connected to the connector pins and risers of the electrical connector.

The present invention according provides for an improved electrical connector for aircraft fuel pumps. The improved electrical connector includes a cup-shaped connector shell or housing, having opposing first and second ends, the first end being closed and the second end being open, and an outer radial connector flange at the first end. The cup-shaped connector shell is preferably formed as a one piece, unitary connector shell, and may be formed of stainless steel, or a corrosion resistant steel, for example. The cup-shaped connector shell is also preferably configured to increase the distance between connector pins and grounded portions of the connector shell to thus increase the length of any potential arcing. A glass electrical insulating plug is mounted in the first end of the cup-shaped connector shell, and forms a hermetic seal of the first end of the cup-shaped connector shell. A plurality of tubular risers are mounted to the glass insulating plug at the first end of the connector shell, with each of the tubular risers having a portion extending from the first end of the connector shell. In a presently preferred embodiment, the tubular risers may be ceramic electrical insulating risers. A plurality of connector pins are mounted in the glass insulating plug and extend longitudinally through corresponding tubular risers, and through the connector shell. In one aspect, each the connector pin includes a solder cup at the first end of the connector shell for receiving a corresponding electrical cable. A plurality of electrical cables are connected to corresponding connector pins, respectively.

In one currently preferred embodiment, at least one outer layer of electrical insulating tubing is provided to cover at least a portion of one or more of the risers, a portion of the connector pins extending from the corresponding tubular risers, and the corresponding electrical cables. In one presently preferred embodiment, the outer layer of electrical insulating tubing may be heat shrunk tubing, such as cross-linked fluoropolymer tubing, and may be formed from two layers of the heat shrunk cross-linked fluoropolymer tubing. Optionally, electrical insulating tubular extension may also be disposed over the outer layer of insulating tubing, the corresponding tubular risers, the corresponding portion of the connector pins extending from the tubular risers, and the corresponding electrical cables.

These and other aspects and advantages of the invention will become apparent from the following detailed description and the accompanying drawings, which illustrate by way of example the features of the invention.

DETAILED DESCRIPTION OF THE PREFERRED EMBODIMENTS

Figure 2:
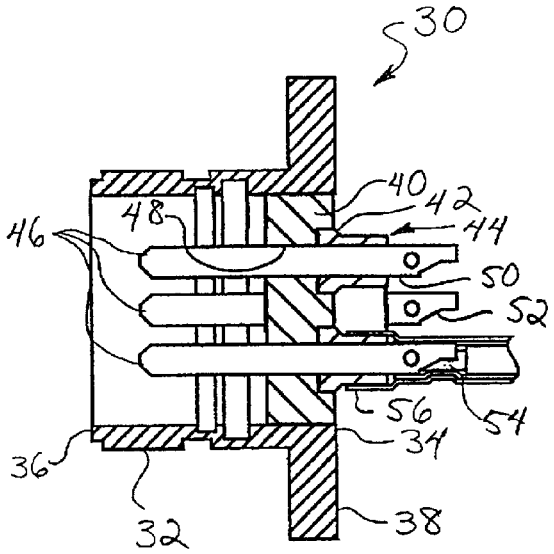
FIG. 2 is a sectional view of the improved electrical connector of the invention for aircraft fuel pumps.

As is illustrated in the drawings, which are provided for the purpose of illustration, but not by way of limitation, the invention is embodied in an electrical connector 30 for aircraft fuel pumps, as is illustrated in FIG. 2. The electrical connector includes a cup-shaped connector shell or housing 32, having opposing first 34 and second 36 ends. The first end 34 is closed and the second end 36 is open for receiving a corresponding connector portion from a fuel pump (not shown). An outer radial connector flange 38 is provided at the first end. The cup-shaped connector shell is typically formed as a one piece, unitary cup-shaped connector shell, and may be formed of a corrosion resistant metal such as stainless steel or corrosion resistant steel, for example. The electrical connector of the invention is configured to increase the distance between connector pins and grounded portions of the shell, to thus increase the electrical current path of any potential arc. The outer radial connector flange is preferably 0.180 inch thick, which is 0.100 inch thicker than the outer radial connector flange of a conventional electrical connector. A glass electrical insulating plug 40 is mounted in the first end of the cup-shaped connector shell, forming a hermetic seal of the first end of the cup-shaped connector shell, and is preferably 0.065 inch thicker than the glass insulating plug of the conventional electrical connector. A plurality of tubular risers 42 are mounted to the glass insulating plug at the first end of the connector shell, each having a portion 44 extending from the first end of the connector shell. The tubular risers are typically constructed of an electrical insulating ceramic material, such as the machinable glass ceramic available from Coming under the trade name "MACOR."

A plurality of connector pins 46 are mounted in apertures 48 of the glass insulating plug, and extend longitudinally through corresponding tubular risers, and through the connector shell. Each of the connector pins includes a portion 50 that extends from the corresponding tubular riser at the first end of the connector shell, with a solder cup 52 located at the first end of the connector shell for receiving a corresponding electrical cable 54. A plurality of electrically insulated electrical cables 54 are typically connected to corresponding connector pins, respectively. At least one additional outer layer of electrical insulating tubing 56 is provided to cover at least a portion of at least one of the risers extending from the first end of the connector shell, a corresponding one of the portion of the connector pins extending from the corresponding tubular risers at the first end of the connector shell, and a corresponding one of the plurality of electrical cables, to provide additional electrical insulation and strain relief at the connection of the electrical cables to the connector pins. The insulating tubing is typically a heat shrunk tubing, such as a cross-linked fluoropolymer tubing available from Raychem under the trade name RT-555. Typically two layers of the heat shrunk tubing are provided over each of the connections of the electrical cables to the connector pins and the tubular risers.

Figure 3:
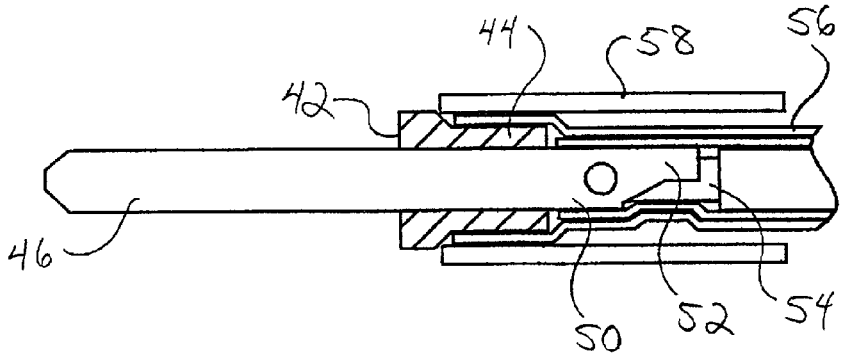
FIG. 3 is an enlarged view of one of the connector pins of the improved electrical connector of FIG. 2, showing the addition of an optional electrical insulating tubular extension.
Figure 1:
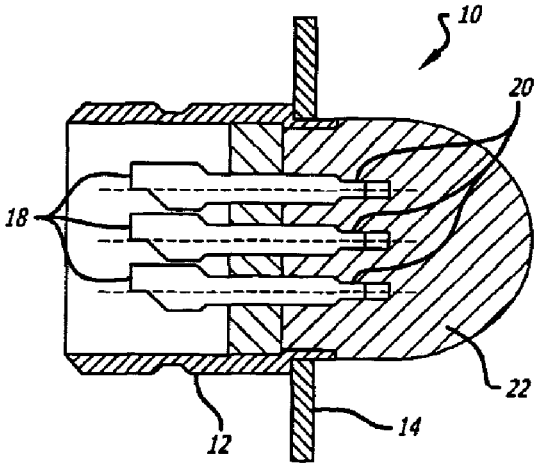
FIG. 1 (Prior Art)
Figure 2:
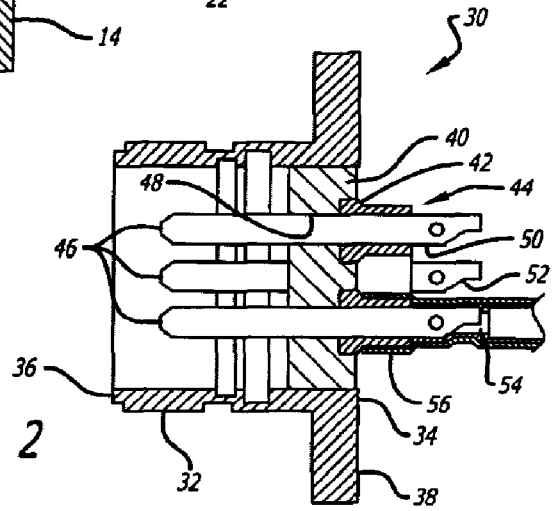
Figure 3:
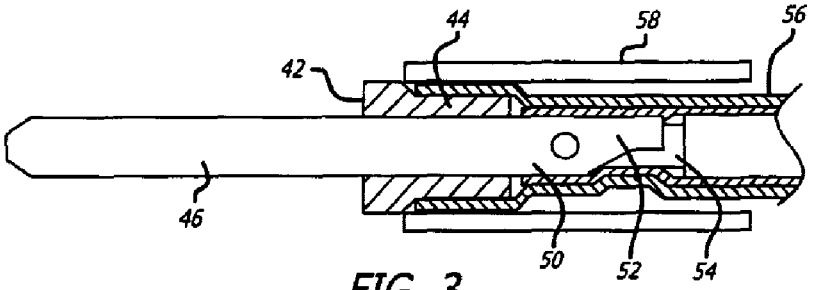

Optionally, as is shown in FIG. 3, at least one insulating tubular extension 58 formed of an electrically insulating material such as ceramic, glass, rubber, plastic or the like, may also be disposed over the outer layer of insulating tubing, tubular risers, connector pins and electrical cables.

From the above, it may be seen that the present invention provides benefits over previous aircraft fuel pump electrical connectors and address significant concerns and shortcomings over previous connectors. It will also be apparent from the foregoing, that while particular forms of the invention have been illustrated and described, various modifications can be made without departing from the spirit and scope of the invention. Accordingly, it is not intended that the invention be limited, except as by the appended claims.

What is claimed is:

1. An electrical connector for aircraft fuel pumps, comprising:

a cup-shaped connector shell, having opposing first and second ends, the first end being closed and the second end being open, and an outer radial connector flange at the first end;

an insulating plug mounted in the first end of said cup-shaped connector shell, said insulating plug having an open side;

a plurality of tubular risers mounted to said open side of said insulating plug, each of said plurality of tubular risers having a base portion mounted to said insulating plug and an outer end portion extending from said open side of said insulating plug;

a plurality of connector pins mounted in said insulating plug and extending longitudinally through corresponding ones of said plurality of tubular risers, through said connector shell, and each having a portion extending from said corresponding tubular risers at the first end of said connector shell;

a plurality of electrical cables connected to corresponding ones of said plurality of connector pins, respectively; and at least one layer of insulating tubing covering a portion of each said outer end portion of said plurality of tubular risers, said at least one layer of insulating tubing covering each said portion of said plurality of connector pins extending from said corresponding tubular risers, and corresponding electrical cables, and leaving an open portion of said base portion of each said tubular riser open and uncovered, whereby contaminants can escape or be removed from said open portion of said tubular risers of said electrical connectors.

2. The electrical connector of claim 1, wherein said cup-shaped connector shell comprises a one piece connector shell.

3. The electrical connector of claim 1, wherein said cup-shaped connector shell is formed from a corrosion resistant metal.

4. The electrical connector of claim 1, wherein said cup-shaped connector shell is formed from stainless steel.

5. The electrical connector of claim 1, wherein said cup-shaped connector shell is formed from corrosion resistant steel.

6. The electrical connector of claim 1, wherein said cup-shaped connector shell is configured to increase the distance between connector pins and grounded portions of the shell to thus increase the electrical current leak path length to prevent arcing from occurring.

7. The electrical connector of claim 1, wherein said insulating plug is formed of glass and forms a hermetic seal of the first end of said cup-shaped connector shell.

8. The electrical connector of claim 1, wherein said plurality of tubular risers are formed from an electrically insulating ceramic material.

9. The electrical connector of claim 1, wherein each of said connector pins comprises a solder cup at said first end of said connector shell for receiving a corresponding electrical cable.

10. The electrical connector of claim 1, wherein said insulating plug is made of glass.

11. The electrical connector of claim 1, further comprising at least one insulating tubular extension disposed over said at least one outer layer of insulating tubing, said outer end portion of said plurality of tubular risers, each said portion of said connector pins extending from said corresponding tubular risers, and said corresponding electrical cables, and leaving said open portion of said base portion of each said tubular riser open and uncovered, whereby contaminants can escape or be removed from said open portion of said tubular risers of said electrical connectors.

12. The electrical connector of claim 1, wherein said at least one outer layer of insulating tubing comprises heat shrunk tubing.

13. The electrical connector of claim 12, wherein said at least one outer layer of insulating tubing comprises cross-linked fluoropolymer tubing.

14. The electrical connector of claim 12, wherein said at least one outer layer of insulating tubing comprises two layers of heat shrunk tubing.

15. An electrical connector for aircraft fuel pumps, comprising:

a unitary cup-shaped connector shell, having opposing first and second ends, the first end being closed and the second end being open, and an outer radial connector flange at the first end;

an insulating plug mounted in the first end of said cup-shaped connector shell, said insulating plug having an open side;

a plurality of tubular risers mounted to said open side of said insulating plug and each of said plurality of tubular risers having a base portion mounted to said insulating plug and an outer end portion extending from said open side of said insulating plug;

a plurality of connector pins mounted in said insulating plug and extending longitudinally through corresponding ones of said plurality of tubular risers, through said connector shell, and each having a portion extending from said corresponding tubular risers at the first end of said connector shell;

a plurality of electrical cables connected to corresponding ones of said plurality of connector pins, respectively; and at least one layer of insulating tubing covering a portion of each said outer end portion of said plurality of tubular risers, said at least one layer of insulating tubing covering each said portion of said plurality of connector pins extending from said corresponding tubular risers, and corresponding electrical cables, and leaving an open portion of said base portion of each said tubular riser open and uncovered, whereby contaminants can escape or be removed from said open portion of said tubular risers of said electrical connectors.

16. The electrical connector of claim 15, wherein said cup-shaped connector shell is formed from a corrosion resistant metal.

17. The electrical connector of claim 15, wherein said cup-shaped connector shell is configured to increase the distance between connector pins and grounded portions of the shell to thus increase the length of any potential electrical current leak path that could cause arcing.

18. The electrical connector of claim 15, wherein said insulating plug is formed of glass and forms a hermetic seal of the first end of said cup-shaped connector shell.

19. The electrical connector of claim 15, wherein said plurality of tubular risers are formed from an electrically insulating ceramic material.

20. The electrical connector of claim 15, wherein said at least one outer layer of insulating tubing comprises heat shrunk tubing.

21. The electrical connector of claim 15, further comprising at least one insulating tubular extension disposed over said at least one outer layer of insulating tubing, said outer end portion of said plurality of tubular risers, each said portion of said connector pins extending from said corresponding tubular risers, and said corresponding electrical cables, and leaving said open portion of said base portion of each said tubular riser open and uncovered, whereby contaminants can escape or be removed from said open portion of said tubular risers of said electrical connectors.

* * * * *

UNITED STATES PATENT AND TRADEMARK OFFICE

CERTIFICATE OF CORRECTION

PATENT NO. : 6,837,744 B2
DATED : January 4, 2005
INVENTOR(S) : Irwin Hei-Wai To et al.

It is certified that error appears in the above-identified patent and that said Letters Patent is hereby corrected as shown below:

Title page showing illustrative figures should be deleted and substitute therefor the attached title page.

Title page,
Item [56], References Cited, U.S PATENT DOCUMENTS, insert the following:
-- 5,017,740 A 5/1991 Honkomp et al.
5,584,716 A 12/1996 Bergman --.

FOREIGN PATENT DOCUMENTS, insert the following:
-- EP 450,153 A 10/1991
FR 2,790,334 A 9/2000
EP 03250801 Search Report dated 5/2003 --.

OTHER PUBLICATIONS, insert the following:
-- Airworthiness Directives, Dept. of Trans., Federal Aviation Administration, 14 CFR part 39;
FAA News, Federal Aviation Administration, APA 159-97, November 26, 1997;
Boeing Service Bulletin, 747 28a2194, ATA 24-44-39th, AIEM 1998 --.

Figure 1:
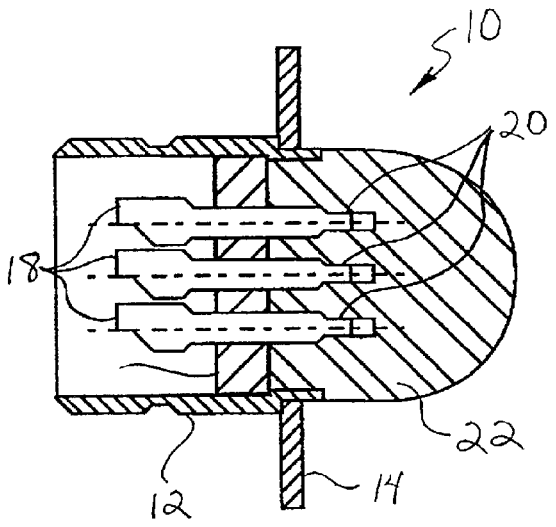
FIG. 1 PRIOR ART
FIG. 1 is a sectional view of a prior art electrical connector for aircraft fuel pumps.

Delete Drawing sheet 1 and substitute therefor the Drawing sheets consisting of Fig 1-3 as shown on attached pages.

Column 3,
Line 28, delete "Coming" and insert -- Corning --

Signed and Sealed this

Twenty-fourth Day of May, 2005

JON W. DUDAS
*Director of the United States Patent and Trademark Office*

(12) United States Patent
To et al.

(10) Patent No.: US 6,837,744 B2
(45) Date of Patent: Jan. 4, 2005

(54) ELECTRICAL CONNECTOR FOR AIRCRAFT FUEL PUMPS

(75) Inventors: Irwin Hei-Wai To, Simi Valley, CA (US); Roderick J. Hunt, Acton, CA (US); Berardino C. Scanderbeg, Valencia, CA (US); Michael Shlimovich, Woodland Hills, CA (US)

(73) Assignee: Hydro-Aire, Inc., Burbank, CA (US)

( * ) Notice: Subject to any disclaimer, the term of this patent is extended or adjusted under 35 U.S.C. 154(b) by 0 days.

(21) Appl. No.: 10/099,882

(22) Filed: Mar. 13, 2002

(65) Prior Publication Data

US 2003/0176105 A1 Sep. 18, 2003

(51) Int. Cl.[7] ..... H01R 13/40
(52) U.S. Cl. ..... 439/587; 439/281
(58) Field of Search ..... 439/587, 281, 439/271, 274, 874, 606; 174/65 G, 151

(56) References Cited

U.S. PATENT DOCUMENTS 4,233,534 A * 11/1980 Tharman ..... 310/71
4,987,283 A * 1/1991 Beinhaur et al. ..... 219/85
6,165,013 A * 12/2000 Broussard ..... 439/606

* cited by examiner

*Primary Examiner*—Alex Gilman
(74) *Attorney, Agent, or Firm*—Fulwider Patton Lee & Utecht, LLP

(57) ABSTRACT

The improved electrical connector for aircraft fuel pumps includes a unitary cup-shaped connector shell with an outer radial connector flange, and is configured to increase the distance between connector pins and grounded portions of the connector shell to thus increase the electrical current leak path length to prevent arcing from occurring. A glass electrical insulating plug in the connector shell forms a hermetic seal of the closed end of the connector shell and a plurality of ceramic tubular risers are mounted to the glass insulating plug. Connector pins extend through the risers, and electrical cables are connected to the connector pins. One or more outer layers of heat shrunk electrical insulating tubing cover the risers, a portion of the connector pins extending from the risers, and the electrical cables. An electrical insulating tubular extension may also be placed over the outer layer of insulating tubing.

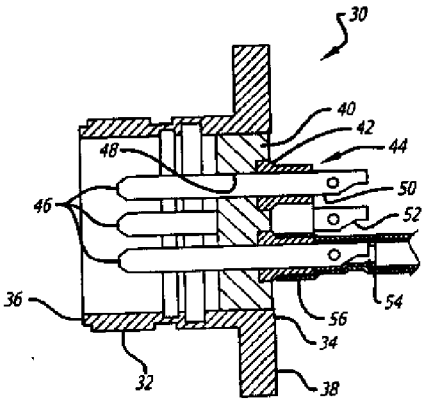

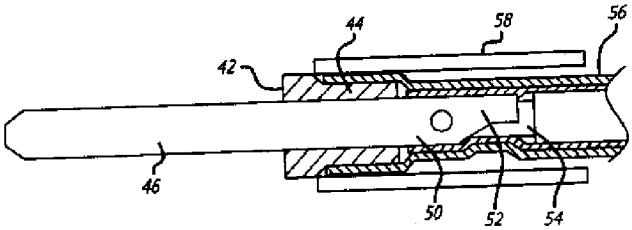

21 Claims, 1 Drawing Sheet